United States Patent [19]

Tinkler et al.

[11] 3,988,794

[45] Nov. 2, 1976

[54] SURFBOARD WITH RESILIENT TAIL

[76] Inventors: Robert C. Tinkler; Michael R. Tinkler, both of 1221 Parker Place, Pacific Beach, Calif. 92109

[22] Filed: June 2, 1975

[21] Appl. No.: 582,668

[52] U.S. Cl. ..... 9/310 E

[51] Int. Cl.[2] ..... A63C 15/00

[58] Field of Search ..... 9/310 E, 310 A, 310 B, 9/310 D, 310 C, 310 R, 310 F

[56] References Cited

UNITED STATES PATENTS

| | | | |
|---|---|---|---|
| 3,317,937 | 5/1967 | Gallagher | 9/310 |
| 3,657,753 | 4/1972 | Blanc, Sr. | 9/310 F |

*Primary Examiner*—Trygve M. Blix
*Assistant Examiner*—Sherman D. Basinger
*Attorney, Agent, or Firm*—Ralph S. Branscomb

[57] ABSTRACT

A surfboard having a resilient bottom panel which extends rearwardly beyond the rigid deck, this being accomplished preferably by splitting the rear portion of the board along the siderails to define a rigid rear deck spaced above a reinforced resilient panel defining the rearward continuation of the board bottom, there being a watertight flexible tailpiece fitted around the deck and over the bottom panel to form a smoothly contoured termination of the board at the rear and retain the hydrodynamic advantages of a conventional surfboard. The advantage of the invention lies in the ability of the trailing portion of the board bottom to flex in response to varying water pressure beneath as the board is being maneuvered, and one or more adjustable lever arms limiting the upward flexure may be provided beneath the rear deck.

13 Claims, 10 Drawing Figures

SURFBOARD WITH RESILIENT TAIL

BACKGROUND OF THE INVENTION

It is well known to surfers that different surf condition call for surfboards or different design and for this reason many accomplished surfers own a variety of boards. Individual technique also dictates to some extent the most appropriate board for a particular surfer.

In an U.S. Pat. application, Ser. No. 376,341, filed July 5, 1973, and now U.S. Pat. No. 3,902,207, applicants disclose a single surfboard of sophisticated design having a resilient bottom tail portion and means to adjust the tension on, and the maximum possible deflection of, the resilient portion so that in effect a variety of boards of different characteristics are combined in a single adjustable model. Adjustments to this surfboard can be made prior to catching a wave or actually in the midst of performing maneuvers.

SUMMARY OF THE INVENTION

The surfboard of the present invention is a modification of the above-mentioned board which, while lacking some of the versatility of the prior design, represents a simplification embodying most of the basic characteristics and advantages of the other board.

In its preferred form, the unit consists of a conventional forward hull which dovetails vertically toward the rear into a rigid rear deck and a resilient bottom panel which extends aft beyond the rear deck, the space above the resilient panel and surrounding the rear deck being filled with a flexible material so that in external contour the board more or less conforms to conventionl surfboard design. This construction permits the bottom rear panel to twist and deflect upwardly in response to increased water pressure therebeneath while providing firm support for the surfer on the rigid rear deck.

Longitudinal flex rods are mounted to the upper surface of the bottom panel and are preferably removable and replaceable with rods of different resiliency, and deflection limiting levers bearing on the flex rods may be pivoted to the underside of the rear deck and restrained in their movement by springs and adjustable stops.

DETAILED DESCRIPTION OF THE PREFERRED EMBODIMENT

Figure 1:
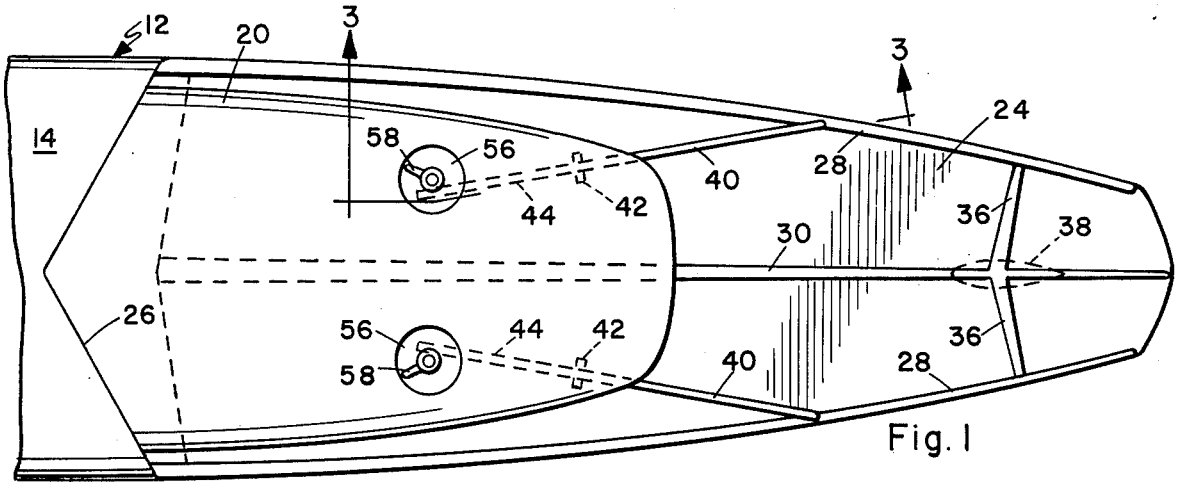
FIG. 1 is a top plan view of the rear portion of a surfboard with the flexible tailpiece removed.
Figure 2:
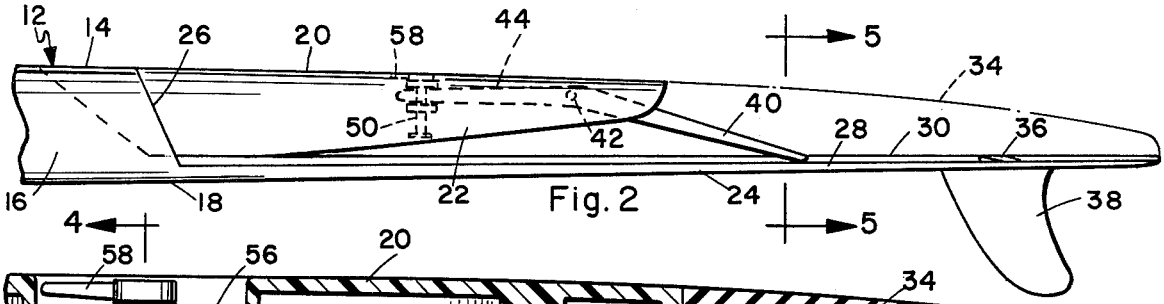
FIG. 2 is a side elevation view of the surfboard as shown in FIG. 1 with the tailpiece shown in phantom.

The surfboard as illustrated in FIG. 1 and 2 has a fragmentarily shown forward hull portion which is of conventional shape and construction and does not in itself represent any features of the invention. The hull has the usual deck 14, side rails 16, and bottom 18. At the rear of the forward hull however, the side rails do not continue rearwardly as in an ordinary surfboard but diverge at an increasing rate to define a rigid rear deck 20 having sidewalls 22 which are slightly upwardly curved rearwardly at their bottom edges as best seen in FIG. 2, the rear deck being smoothly contoured in planform as seen in FIG. 1.

The bottom of the forward hull is extended rearwardly well beyond the rear deck to define a deflection panel 24, and whereas the deck 20 is clearly shaped for strength and rigidity, the rear bottom panel is generally straight laterally and is made of a resilient material so that it may be deflected upwardly in a uniform rearward arc, or twisted, independently of the rear deck. It is this resilience of the bottom panel coupled with the right rear extension of the deck on which the surfer places his rear foot, thereby providing a sure footing for the surfer and at the same time a variably shaped bottom surface of the board, which lies at the heart of the invention. Actual use has proven the advantages of this combination of bottom rear resilience and deck rigidity over conventional surfboards.

Although perhaps not quite as effective in use, the board could be made without the split rails, the upper deck and foam filler material simply terminating forward of the rearwardly extending deflection panel so that the rear deck (see FIG. 2) would continue laterally, curving down to meet the bottom panel, replacing the forward projections of the tailpiece and defining a substantially straight rear end wall of the deck extension. This arrangement, not shown but obvious from the illustrated embodiments, and would permit the flexing of the bottom panel independently of the remainder of the surfboard, although clearly the length of the flexible panel could not be as great as in the preferred embodiment in which it extends forward beneath the rigid deck. Also, in the above mentioned embodiment in which the split rail structure is eliminated, the extension panel could be hinged to the forward bottom portion rather than being integral with it.

Figure 7:
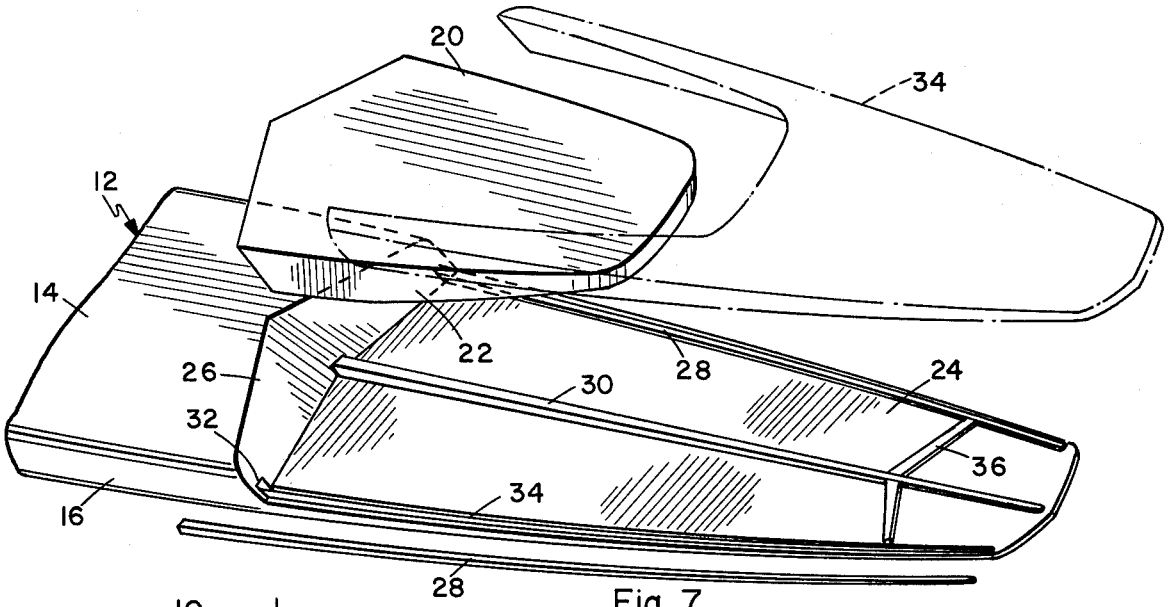
FIG. 7 is an exploded perspective view of the rear portion of a surfboard showing one of the flex rods removed.

From the aspect of manufacturing ease, it may be desireable to cut the rear deck from an integral blank. This is done such that the forward edge of the rear deck is V-shaped in planform and beveled vertically as shown at 26 to produce an expanded area which abuts and is glued to the complimentary surface of the forward hull. It should also be noted that since the side edges of the rear deck are gently curved, so that as the deflection panel arches upwardly, it makes contact with increasingly rearward portion of the rear deck to provide needed support as stress on the panel increases. The deflection panel 24 is generally planar, tapering slightly forward to aft, ad should incorporate longitudinal flex members which could be bands of graphite fibers or the like molded directly into the panel. In the illustrated embodiments, these members comprise a pair of flex rods 28 along the edges of the flex panel, and a central flex rod 30. These rods may be glued to the deflection panel as shown in FIG. 1 or removably attached as shown in FIG. 7, wherein the forward ends of the flex rods are engaged in sockets in the forward hull, such as that shown at 32, with the remaining lengths secured in channels such as 34. The removeably flex rods may be replaced by others of more or less resilient strength to accomodate different surfing conditions or surfers of different weights or board preferences. An additional pair of cross supports 36 similar in construction to the flex rods are needed immediately above the skeg 38 so that skeg torque is delivered to the deflection panel as a whole rather than being localized as a destructive buckling force.

The skeg is in part responsible for the improved performance of the flexible-tailed board in that lateral water pressure on the skeg will twist the deflection panel to an advantageous angle during maneuvers. Additionally, during turns the twisted deflection panel will hold the skeg more vertically in the water to yield more controlability than would be the case using a rigid bottom. Other advantageous results have been observed which are achieved by complex interactions of the skeg, flex panel, and water.

Surrounding the edges of the rear deck and extending to the edges of the deflection panel is a flexible, waterproof tailpiece 34 fabricated of a synthetic foam material, a molded skin filled with air, or the like. The tailpiece continues the natural contour of the surfboard on the upper surface, and is sealed water-tight to the rear deck and deflection panel, the underside being cut away in certain areas to accomodate the apparatus desribed below. The tailpiece, of course, yields to the deflection of the bottom panel and provides bouyancy without substantially distorting the generally advantageous hydrodynamic upper surface of the board.

The board as thus described with no additional structure represents an advanced design that out performs surfboards of conventional design. It is emphasized that this is the case, and that the additional apparatus described below, while adding to the advantages provided by the board, are an extension of the basic invention and not essential to proper operation, as is expressed in the claims.

Figure 3:
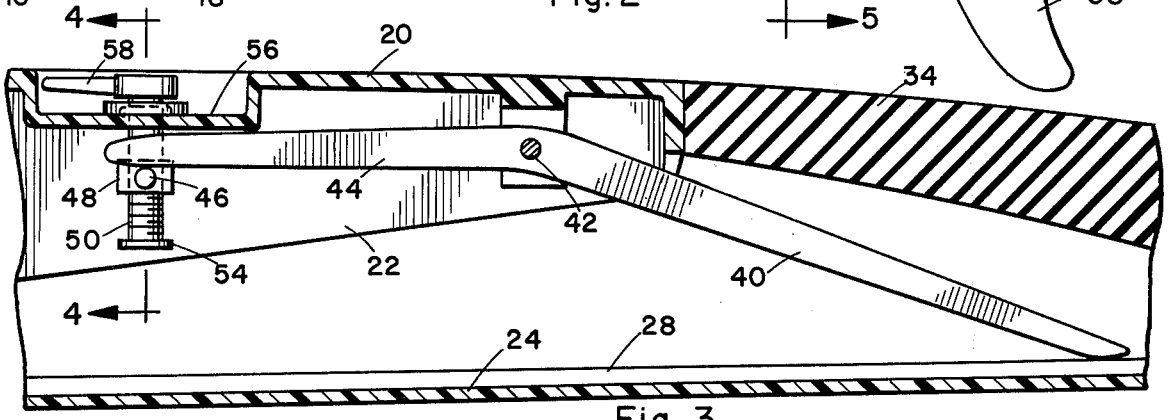
FIG. 3 is an enlarged section detail taken along lines 3—3 of FIG. 1.
Figure 4:
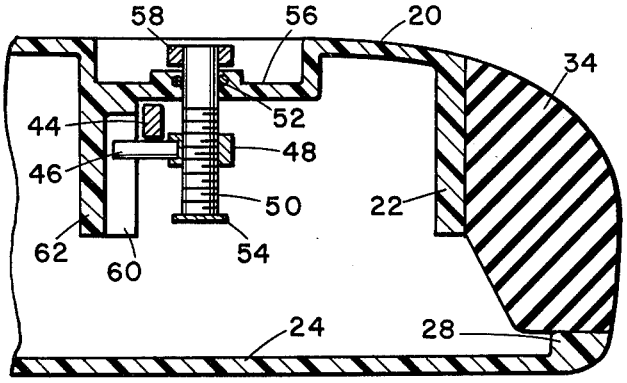
FIG. 4 is a section detail taken along lines 4—4 of FIG. 3.
Figure 5:
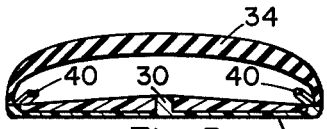
FIG. 5 is a section taken along line 5—5 of FIG. 2.

To further increase the versatility of the board, there may be provided between the rear deck and the deflection panel a means to adjustably limit the panel movement, this being accomplished in the absence of such means by the rear deck itself and the flex rods. One or more lever arms 40, three of which are shown, are fulcrummed or pivoted to the underside of the rear deck at 42. Each of the arms extends rearwardly to ride on or near one of the ribs 28 and 30, and has a forward extension 44 which is limited in its downward movement by a bumper 46 as shown in FIGS. 3 and 4. The bumpers are secured at one end in threaded riders 48 which are engaged on the threaded lower ends of shafts 50, these shafts being journaled in the rear deck and made water-tight with O-rings 52 and having retaining collars 54 on the lower ends. A circular depression 56 is formed in the rear deck around each shaft, and a lever-type knob 58 is attached to each shaft and is operable externally of the surfboard.

As shown in FIGS. 3 and 4, the other ends of the bumper rods 46 are slideably seated in slots 60 defined in guide members 62 which are preferably molded integrally with the rear deck. It can thus be seen that by adjusting one or more of the levers 58 the bumper rods 46 can be individually positioned to define separate limits of travel for the extensions 44, thus setting maximum deflection limits for individual portions of the surfboard by virtue of the action of the lever arms 40 on the reinforcing ribs or other areas of the panel.

Figure 8:
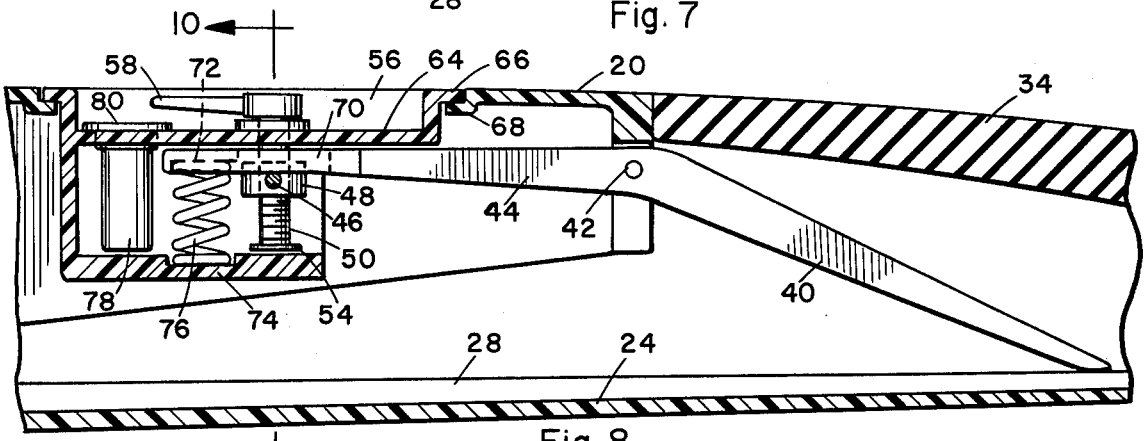
FIG. 8 is a sectional view of a modification of the lever structure showing the insert housing and spring assembly.
Figure 9:
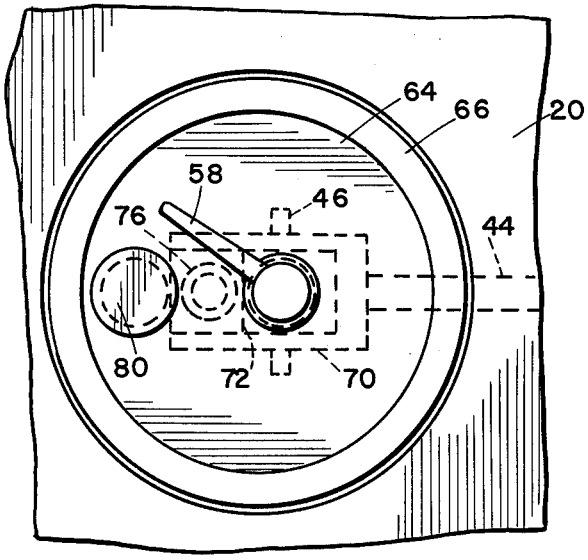
FIG. 9 is a section taken along lines 9—9 of FIG. 8.
Figure 10:
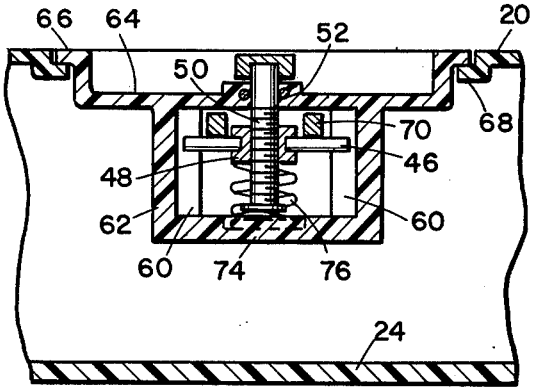
FIG. 10 is a top plan view of a portion of the rear deck showing the housing insert for the level arm limiter.

A modification of the deflection limiting structure is shown in FIGS. 8–10, in which the circular depression 56 is formed in an insert housing 64. The insert has an annular lip 66 which seats in and is glued or otherwise attached to a shoulder 68 which defines an opening in the rear deck for the insert. In this modification, the forward extension 44 of each lever arm is bifurcated to form a yoke or fork 70 which straddles the respective shaft 50, and the structure of the bumpers 46 and riders 48 is duplicated for each fork, as shown in FIG. 9, so that both lines are supported on bumpers.

In addition, the tines of each fork are connected by a spanner 72 forward of the shaft, and the insert housing 64 includes an integral spring retainer cup 74 disposed below the spanner bar, and a coil spring 76 is captured between the cup and the spanner. This spring obviously provides additional resistance to flexure of the panel 24 and flex rods 28 and 30, and may be omitted in any instance in which it is not necessary, or replaced with another spring of lesser or greater strength. To enable the spring to be easily removed, an access chamber 78 is formed in the housing adjacent the spring, having an opening through the deck which is sealed by a removeable, preferably threaded plug or cap 80.

The primary purpose of using the insert housing structure as opposed to a straight deck is to enable the assembly of the stop means as a separate unit in the housing, which is inserted so that the shaft engages the forked end of the pre-mounted lever arm, subsequent to which the spanner bar is attached.

As an alternative to the insert housing construction, the lever arm structure could be mounted to the rear deck prior to reattachement of the separated rear deck portion to the remainder of the board. An additional advantage of providing the rear deck and lever arms initially separate from the remainder of the board lies in the ease with with this structure may be incorporated in an existing board. If the surfboard is of honeycomb construction, in which the top and bottom of the board are ordinarily manufactured separately anyway, there would be no need to make the rear deck as a separate member.

Figure 6:
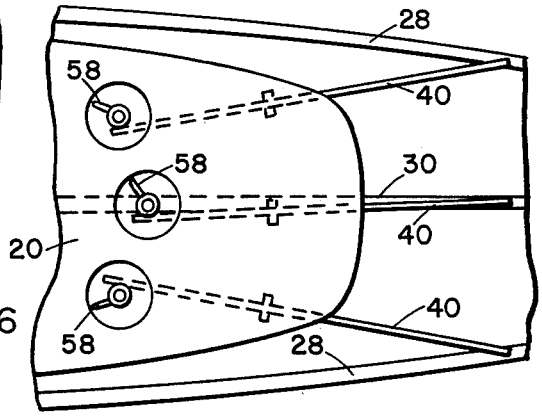
FIG. 6 is a top plan view of a portion of a surfboard incorporating three lever arms.

In the prior invention of applicants, a motor-driven limiting means for the lever arms is disclosed. This motorized concept could be applied to the instant invention with minor modifications, such that one, two, or all three of the lever arms represented in FIG. 6 could be driven independently, or coordinated in one way or another. It is also quite conceivable that the general principles disclosed herein could be applied to a slalom water ski, which would be advantageous especially in obstacle course racing since the flex of the ski should vary as a function of speed and the degree of the turns required.

The invention as thus described, in its simplest and more complex forms, represents the latest stage in the development of the surfboard art, and is expected to sweep the sport of surfing, at least among its most ardent enthusiastics.

We claim:

1. A surfboard comprising:

a. a forward hull portion having a deck, a bottom, and siderails;

b. a rear hull having:

i. a rigid upper rear deck defining a continuation of the deck of said forward portion and being substantially non-yielding;

ii. a resilient bottom deflection panel defining a continuation of the bottom of said forward portion and extending rearwardly beneath said rear deck and being upwardly deflectable independently of said rear deck such that a surfer can stand on said surfboard with one foot on said rear deck and said deflection panel can deflect upwardly beneath said rear deck without causing a similar deflection therein.

2. Structure according to claim 1 wherein said forward hull portion diverges along the siderails at the rear end thereof to define said rearwardly-extended resilient bottom panel and said rigid rear deck such that said rear deck is above and spaced from said bottom panel to permit upward deflection of said panel independently of said deck, and including a flexible tailpiece sealed to and between the edges of said deck portion and said bottom panel and extending substantially to the rear end of said resilient panel to define a smooth rearward continuation of said side rails and deck.

3. Structure according to claim 1 and including a plurality of longitudinally-extended resilient flex rods mounted on the top of said resilient bottom panel and extending the substantial length thereof.

4. Structure according to claim 3 wherein a plurality of said flex rods are removably mounted on said resilient bottom panel, whereby flex rods of different resiliency can be alternately mounted to said resilient bottom panel.

5. Structure accordlng to claim 3 wherein a pair of said plurality of flex rods extend along the opposite edges of said resilient bottom panel, and including a skeg extending downwardly from said resilient bottom panel, said resilient bottom panel having lateral brace means above said skeg and extending between said pair of flex rods to prevent buckling of said panel in use from laterally directed skeg pressure.

6. Structure according to claim 1 wherein said rear deck has means mounted thereto specifically and definitively to limit the upward movement of said resilient panel.

7. Structure according to claim 6 wherein said limiting means comprises a lever arm fulcrummed to the underside of said rear deck and having a rearwardly extending portion contacting said panel, an including stop means to define a position of maximum upward deflection of said lever.

8. Structure according to claim 7 and including a module housing said stop means, said module being mounted in an opening provided in said rear deck and comprising a portion thereof.

9. Structure according to claim 8 wherein said resilient panel is provided with a pair of longitudinally extended flex rods along the side edges thereof, and said limiting means is duplicated with the lever arms thereof riding on said flex rods.

10. Structure according to claim 7 wherein said stop means comprises a shaft journalled in said rear deck and having a threaded lower portion; and a rider threadedly engaged on the threaded portion of said shaft, said lever arm having a foward extension with a bifurcated end straddling said shaft above said rider, said shaft being rotatably adjustable to raise and lower said rider to vary the position of maximum upward deflection of said lever arm.

11. Structure according to claim 7 wherein said lever arm has a forward extension and including spring means biasing said forward extension upwardly toward said rear deck.

12. Structure according to claim 11 and including a coil spring retainer mounted to and beneath said rear deck and below said forward extension, said spring means comprising a coil spring captured between said retainer and said forward extension.

13. Structure according to claim 12 and including a removably capped opening in said rear deck adjacent said coil spring whereby said coil spring is removable and replaceable.

* * * * *